US008007350B2

(12) United States Patent
Wenskus et al.

(10) Patent No.: US 8,007,350 B2
(45) Date of Patent: Aug. 30, 2011

(54) APPARATUS FOR THE PAYOUT OF COINS FROM A PAIR OF NEIGHBOURING COIN TUBES

(75) Inventors: Dieter Wenskus, Beckdorf (DE); Torsten Schneider, Apensen (DE)

(73) Assignee: National Rejectors, Inc. GmbH, Buxtehude (DE)

( * ) Notice: Subject to any disclaimer, the term of this patent is extended or adjusted under 35 U.S.C. 154(b) by 338 days.

(21) Appl. No.: 12/166,856

(22) Filed: Jul. 2, 2008

(65) Prior Publication Data

US 2009/0017739 A1 Jan. 15, 2009

(30) Foreign Application Priority Data

Jul. 10, 2007 (DE) ..... 10 2007 031 955

(51) Int. Cl.
*G07D 1/00* (2006.01)

(52) U.S. Cl. ..... 453/49; 211/231

(58) Field of Classification Search ..... 453/49, 453/57; 221/222, 231

See application file for complete search history.

(56) References Cited

U.S. PATENT DOCUMENTS

| | | | | |
|---|---|---|---|---|
| 2,778,368 | A * | 1/1957 | Jaskowiak | 453/29 |
| 3,191,609 | A * | 6/1965 | Gauselmann et al. | 453/40 |
| 5,330,384 | A * | 7/1994 | Shapley et al. | 453/17 |
| 5,595,535 | A * | 1/1997 | Wenskus | 453/40 |

FOREIGN PATENT DOCUMENTS

| | | |
|---|---|---|
| DE | 33 15 982 C2 | 8/1984 |
| DE | 38 10 074 A1 | 5/1989 |

(Continued)

*Primary Examiner* — Jeffrey A Shapiro
*Assistant Examiner* — Mark J Beauchaine
(74) *Attorney, Agent, or Firm* — Vidas, Arrett & Steinkraus

(57) ABSTRACT

An apparatus for the payout of coins from a pair of neighbouring coin tubes, in which one stack of coins at a time is supported on the bottom of a coin tube, with a payout disc below the coin tubes, which is rotatably mounted around an axis parallel to the axis of the coin tubes and which has a payout element on the side facing the coin tubes, which is moved along a curved slit in the bottom of the respective coin tube in an angular rotation of the payout disc, in order to capture the respective lowermost coin and to push it out, with an electric drive motor for the payout disc and a control device, which triggers the drive motor such that departing from a rest position, the payout disc is rotated at option about a limited rotational angle up to a final position, and is consecutively turned back into the rest position, wherein the payout disc has an extension in the rotational direction by which the stack of coins rests on the payout element in the final position of the payout disc, characterised in that on the lower side of the payout disc a stopper element is provided, which co-operates near the final positions with one dead stop at a time, the payout disc has a first mark on the side opposite to the stopper element which is detectable by two sensors arranged side by side, the payout disc has further one second mark at a time at both sides of the stopper element which is detectable by a sensor, wherein the second marks are situated in the region of the sensor when the payout disc is in one of the final positions, and the sensors are connected to the control device and the control device reduces the speed of the drive motor when one of the second marks reaches the sensor which is the first one in the rotational direction and reverses its rotational direction when it reaches the second sensor.

9 Claims, 4 Drawing Sheets

FOREIGN PATENT DOCUMENTS

| | | | |
|---|---|---|---|
| DE | 42 14 366 | A1 | 10/1993 |
| DE | 44 26 585 | C2 | 1/1996 |
| DE | 44 26 193 | C2 | 6/1999 |
| EP | 0 690 418 | A2 | 5/1995 |
| EP | 1 302 909 | A1 | 9/2001 |
| GB | 2 335 775 | A | 3/1998 |

* cited by examiner

APPARATUS FOR THE PAYOUT OF COINS FROM A PAIR OF NEIGHBOURING COIN TUBES

CROSS-REFERENCE TO RELATED APPLICATIONS

Not applicable.

STATEMENT REGARDING FEDERALLY SPONSORED RESEARCH

Not applicable.

BACKGROUND OF THE INVENTION

Coin apparatuses equipped with money changing devices have so-called coin stacking tubes or just simply coin tubes, in which the coins to be paid out are stored according to their values. The coin stacks inside the tubes are supported by the bottom of the coin tubes. A payout device removes the coins individually on the lower edge of the tubes via a lateral slit, after instruction by a payout command. It is known to use electric magnets or electric motors for this purpose, which push out the respective lowermost coin with the aid of a payout element and guide it to an output channel, for instance.

From DE 38 10 074, the entire contents of which is incorporated herein by reference, it has become known to associate one payout unit to one pair of coin tubes. It contains an electric motor, which drives two throw out elements, each one associated to one coin, via a freewheel mechanism. Depending on the rotational direction of the electric motor, one of the two coin tubes is triggered by the associated throw out element. From DE 42 14 366, the entire contents of which is incorporated herein by reference, a coin output apparatus has become known, in which one drive motor switchable in its rotational direction is associated to one pair of coin tubes, which drives one single cam lobe via a gearbox arrangement, which pushes out the respective lower coin via an exit slit of a coin tube, wherein the rotational movement of the cam lobe is controlled depending on the rotational direction, such that the cam lobe pushes out a coin from a first tube when it is rotated about 360°, and under crosses the second tube. The single throw out element is constituted by a spring loaded pin, which is pre-tensioned into the release position and is lifted by a cam curve when it is to be brought into the throw out position.

From DE 33 15 982 C2, the entire contents of which is incorporated herein by reference, an apparatus has become known, in which one rotor disc with one single cam lobe is assigned to each coin tube. Thus, the disc must perform a 360° rotation for payout, in order to reach the opening position.

From DE 44 26 585 C2 or DE 44 26 193 C2, the entire contents of which is incorporated herein by reference it also become known to let a payout rotor or a payout disc with one or two height-adjustable cam lobes perform a rotation about only 180°. In the payout operation, the payout disc performs an 180° rotation either in the one or in the other direction. When moving back into the rest position, the payout cam lobe or the payout element has to be lowered, so that it can reach the rest position below the tube bottom or the lowermost coin, respectively.

From EP 1 302 909 A1, the entire contents of which is incorporated herein by reference it is known to connect a lobe-like payout element with a motor driven payout disc. The extension of the payout element in the rotational direction is such that the coin stack rests on the same when the payout element is moved from its rest position into a final position, in order to push out a coin.

The present invention is based on the objective to provide an apparatus for the payout of coins from a pair of neighbouring coin tubes, the constructional expenditure of which can be reduced with the concomitant possibility of faster payout and with a long servicing lifetime.

BRIEF SUMMARY OF THE INVENTION

Even in the apparatus of the present invention, the payout element has an extension in the rotational direction which has the effect that the coin stack rests on the payout element in the final position of the payout disc.

When the payout disc is rotated in the one or in the other direction with the aid of the drive motor, the payout element pushes out the lowermost coin in the direction of the payout or return channel, respectively, like in the state of the art. However, the payout element is executed such as to permit that a return into the rest or initial position is still possible even when the lowermost coin has been pushed out, without changing the height of the payout element. Typically, only a rotational angle of about 120° is necessary for this. Therefore, it has to be taken care in the control device that the rotational angle is accurately maintained. In every case, this rotational angle is smaller than in known payout apparatuses, so that the payout operation proceeds significantly faster than in the state of the art. A further advantage of the present invention is that the payout element has to be an elevation on the payout disc only. A complicated cinematic construction for lifting and lowering a payout pin, as is the case in the state of the art, can be omitted. Through this, even the wear of the payout apparatus according to the present invention is significantly reduced. The servicing lifetime of the payout apparatus is significantly prolonged.

As has been mentioned already, it has to be taken care in the final position of the payout element that it supports the coin stack at the same time. This can take place in that the payout element consists of two more or less spaced apart sections. However, it is advantageous when the upper side of the payout element has a fully planar surface area.

Further, it has to be noted that the payout disc must not necessarily be a fully more or less plane parallel disc, an essentially flat rotor which can be driven by the drive motor and which carries the mentioned payout element is sufficient instead.

The control device provides that when triggered correspondingly by the coin apparatus, the payout disc travels the angle in the desired rotational direction in order to push out a coin. Further, the control device provides that the drive motor reverses its rotational direction when it reaches the final position, in order to move back the payout disc into the rest position. In order to make this process safe, in particular in order to avoid that the payout disc is rotated over the final position, a stopper element is provided on the lower side of the payout disc in the invention, which co-operates near the final positions with one dead stop at a time. By doing so, it is prevented the payout disc is rotated over the final position, which would have the effect that the coin stack falls on the bottom of the coin tube. In this case, it would be no more possible to move back the payout disc into the rest position. In this context, a further embodiment of the invention envisions that the stopper element is attached to be resilient. According to a further embodiment, this takes place in that the payout disc is formed from plastic material and the stopper element is formed on an elastically slewable, preferably radial finger. When the payout disc is not stopped in good time, it is resiliently braked down in this way. By the spring-like effect it is achieved that the drive motor or the gearbox, respectively, is not damaged by too strong braking action.

Different drive options for the payout disc are conceivable. According to the invention, one of them envisions that the payout disc has a toothed ring on its bottom side, which co-operates with a drive pinion of the drive motor. The toothed ring may be formed on the inner side of a circumferential shoulder of the payout disc. The drive pinion is situated eccentrically inside the shoulder with its axis and engages into the toothed ring.

It is conceivable to envision the drive motor as a stepping motor or as a positional drive. However, such drives are very sumptuous. According to one embodiment of the invention, a conventional simple DC motor is used for this reason. In order to be able to use it, the invention envisions that the payout disc has a first mark which is detectable by two sensors, the payout disc has further one second mark at a time at both sides of the payout element, which is detectable by a sensor, wherein the first mark is situated in the region of the sensor when the payout disc is in the rest position, and the second marks are situated in the region of the sensor when the payout disc is in one of the final positions, and the sensors are connected to the control device. When seen in the rotational direction of the payout disc, the sensors are two sensors arranged side by side, wherein according to another embodiment of the present invention, the extension of the first mark in the rotational direction of the payout disc is somewhat greater than the distance of the sensors. When the payout disc is moved in the one rotational direction with the aid of the drive motor, the associated second mark reaches the sensor when a push out operation is just finished. Thereafter, a reversal of the rotational direction of the drive motor takes place, and the payout disc comes back into the rest position again, which is monitored by the sensor via the first mark. The rest position can be accurately adjusted by two sensors arranged side by side. Furthermore, in the invention the first sensor, which is reached when the payout element approaches the sensors, switches the drive motor to a lower speed, so that a too sudden speed change does not take place in the reversal of the rotational direction when the second mark reaches the second sensor.

When the first mark does not cover both sensors in the rest position of the payout disc, it may be readjusted in that the drive motor is reversed another time and it rotates the payout disc so far until both sensors are covered by the first mark. Arbitrary sensors can be used as the sensors, which are able to retrieve the marks arranged on the payout disc. To these belong optical or Hall Effect sensors in particular.

BRIEF DESCRIPTION OF THE SEVERAL VIEWS OF THE DRAWINGS

The present invention is explained in more detail in the following by means of an example of its realisation.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
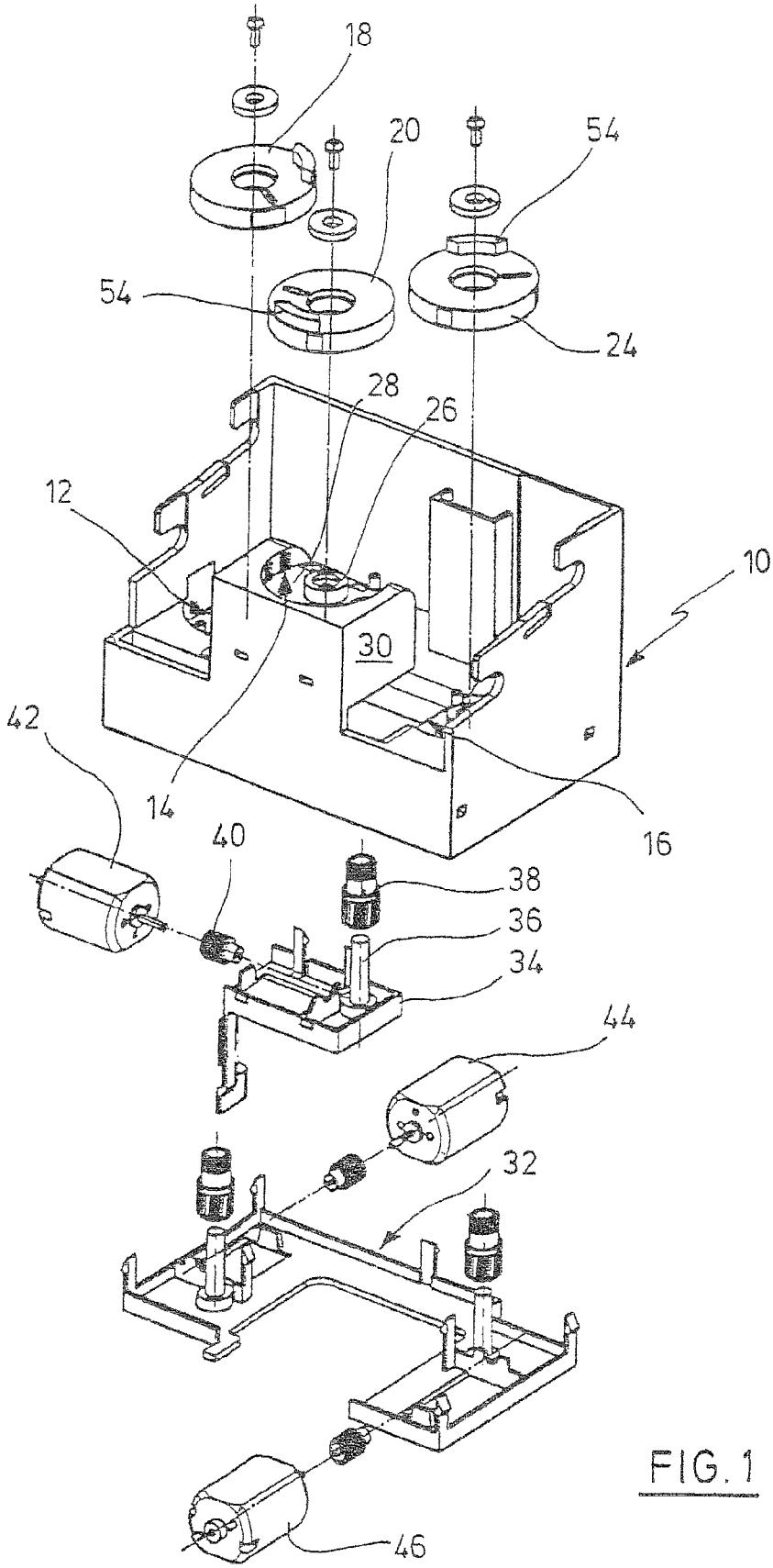
FIG. 1 shows an apparatus according to the present invention in an exploded perspective view.
Figure 2:
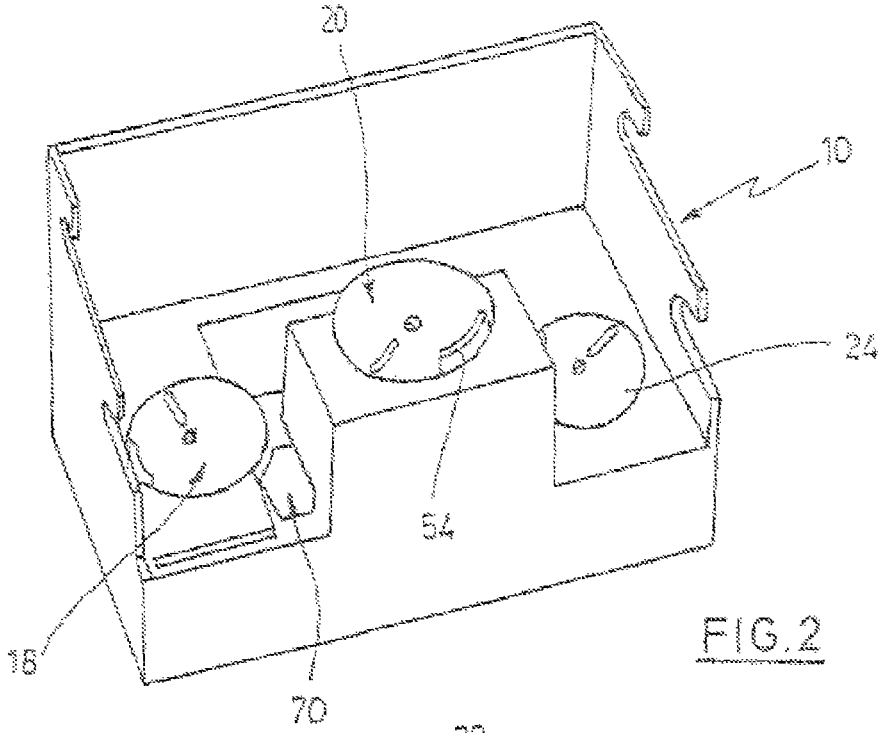
FIG. 2 shows the casing of the apparatus according to FIG. 1 after the installation of the payout discs, in a magnified perspective view.

In a casing 10 for a coin payout apparatus, three accommodations 12, 14, 16 for three payout discs 18, 20, 24 are represented (FIGS. 1 and 2). The payout discs 18 to 24 are rotatably mounted in the accommodation via a ring shoulder and a corresponding bearing surface. A ring shoulder 26 can be recognised for the accommodation 14, as well as a bearing surface 28. The accommodations 12 and 16 lay in a first plane, and the accommodation 14 on a pedestal 30 of the casing in a second plane elevated with respect to the former plane. On the lower side of the casing 10, corresponding mountings 32 and 34, respectively, are arranged for the drive of the payout discs 18 to 24. The mounting 34 has a bearing pin 36, for a double pinion 38 with an upper and a lower toothed ring. The lower toothed ring co-operates with an endless screw 40, which is driven by an electric motor 42. Together with the endless screw 40, the electric motor 42 is held by the mounting 34, which on its part can be caught in the casing 10 from the bottom side by a clip connection. The mounting 32 has further electric motors 44, 46, which drive the other payout discs in the same manner as described for mounting 34. Thus, the electric motor 42 drives the payout disc 20, and the electric motors 44, 46 drive the payout discs 18 and 24. The mounting 32 is also clipped into the casing 10.

Figure 5:
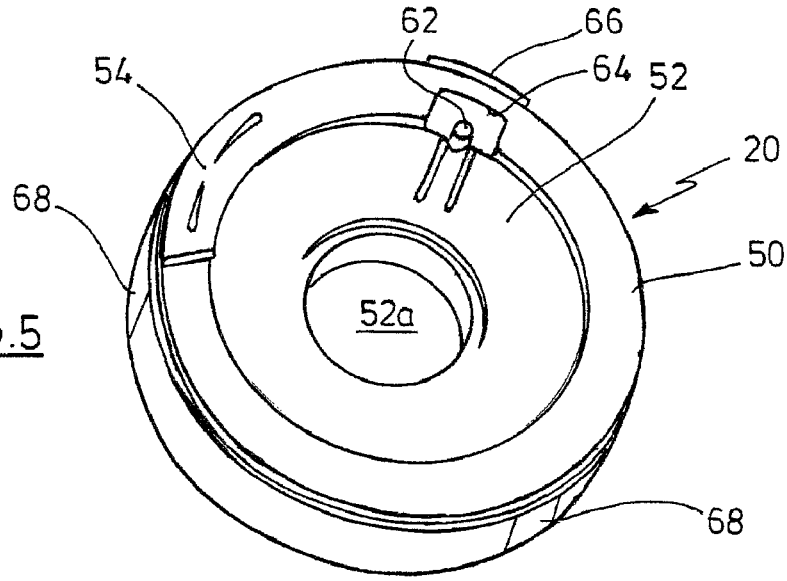
FIG. 5 shows a payout disc for the apparatus according to FIG. 1, in a magnified perspective view.
Figure 6:
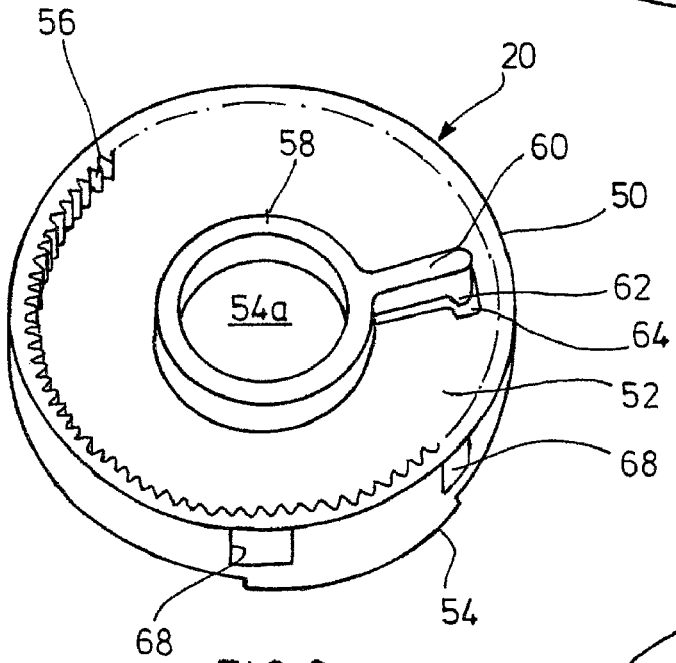
FIG. 6 shows the lower side of the payout disc according to FIG. 5, in a perspective view.

The payout discs have a construction which emerges in more detail from FIGS. 5 and 6.

In FIGS. 5 and 6, the payout disc 20 is represented, for instance. The remaining payout discs 18 and 24 have an identical construction. The payout disc 20 is composed of a thicker outer ring section 50 and an inner, less thick ring section 52. An opening 54*a* accommodates the ring shoulder 26 of the accommodation 14. On the upper side of the outer ring section 50 sits a payout element 54 in the form of an elevated ring segment. On its lower side, the ring section 50 has a toothed ring 56 at the inside. In addition, the inner ring section 52 is formed with an inner ring shoulder 58, which circularly surrounds the opening 54*a*. A finger 60 extending towards the outside is formed radially on the ring shoulder 58. At the end of the finger 60, a pin 62 is formed, which extends into a slit 64. The pin 62 and the slit 64 can be better recognised in FIG. 5. The slit 64 has a certain extension in the circumferential direction. The finger 60 is elastic, because the plastic material from which the payout disc 20 is formed in one single piece features a certain elasticity. Therefore, the pin 62 can be moved inside the slit 64 when a force in the circumferential direction is exerted on it.

In FIG. 5, a first mark is provided at 66 in the form of a ring section. One of two further marks can be recognised at 68. In FIG. 6, two second marks 68 are represented.

The upper toothed ring of the pinion 38 co-operates with the toothed ring 56. For this reason, the electric motor 42 causes a rotation of the payout disc 20, wherein its rotational direction determines the rotational direction of the payout disc 20 also.

Figure 3:
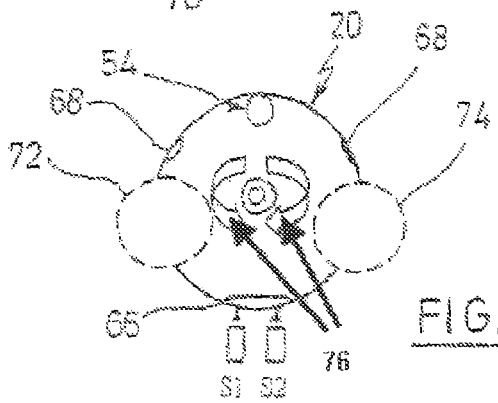
FIG. 3 shows a payout disc in a top view, for explaining its function.

In FIG. 2, the casing 10 with the accommodated payout discs 18, 20 and 24 is shown. In addition, one recognises at 70 an exit for coins which are given out. Namely, as can be recognised from FIG. 3, one pair of coin tubes 72, 74 (drawn in dashes) is associated to each payout disc 20. With their bottoms, they are situated above the payout disc 20. For the matter of simplicity, the payout element 54 is drawn only as a greater circle. In addition, one recognises in an exemplary manner the first and second marks 66, 68. The two rotation arrows 76 indicate the two possible rotational directions of the payout disc 20. In FIG. 3, the rest position of the payout disc 20 is shown. In this position, two sensors S1 and S2 are situated opposite to the payout element 54. In the rotational direction of the payout disc 20, they have a certain distance from each other, which is somewhat smaller than the extension of the first mark 66 in the rotational direction. The second marks 68 are each one set off about 120° against the payout element 54.

By means of FIG. 3, the payout of coins is to be explained. When a coin of the tube 74 is to be paid out, the not shown control device for the electric motors 42, 44 and 46 gives a signal for the electric motor 42, and the payout disc 20 rotates clockwise. In the bottom of the not shown coin tube 74 there is a circular slit, through which the payout element 54 enters into the coin tube 74 and pushes out the lowermost coin. The payout disc 20 continues to rotate, until the second mark 68 reaches the sensor S2. The sensor S2 causes that the electric motor 44 reduces its speed. When the second mark 68 reaches the second sensor S1, the rotational direction of the electric motor is reversed and the payout disc 20 is rotated back. The electric motor is stopped when the first mark 66 covers both sensors S1 and S2. If this is not completely fulfilled, according to the circumstances the electric motor is operated in the reverse rotational direction another time, until this is fulfilled. It has been mentioned already above that the payout element 54 is executed such the payout element 54 supports the stack of coins even in the final position of the payout disc 20, so that the payout element 54 can slide back into the rest position without problems, along the bottom side of the lowermost coin of the stack of coins. In the payout of the coin tube 72, the payout disc 20 is rotated counter clockwise. However, the process proceeds in the same manner as already described.

Figure 4:
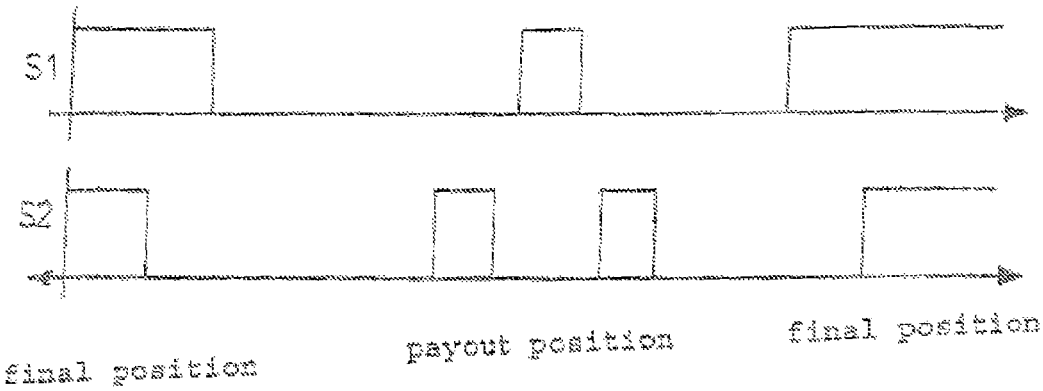
FIG. 4 shows a diagram in connection with the payout disc according to FIG. 3

In FIG. 4, the diagram for the two sensors S1 and S2 is shown. When the payout disc 20 is rotated clockwise, the sensor S1 generates a signal for a longer time than the sensor S2, because the first mark 66 covers the sensor S1 for a longer period of time. The first mark 68 reaches the sensor S2 at first and only thereafter the sensor S1. When the rotational direction is reversed, a signal is generated by the sensor S2 another time, until the mark 66 reaches the sensors, namely here the sensor S1 at first and only thereafter the sensor S2, which are then both covered by the mark 66.

Figure 7:
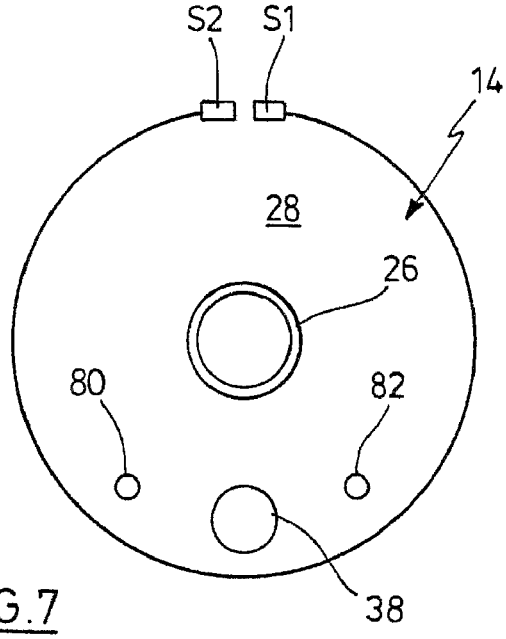
FIG. 7 shows the top view on the casing section below a payout disc, with two dead stops, in a very schematic fashion.

In FIG. 7, the accommodation 14 according to FIG. 1 is schematically represented, with the sensors S1 and S2 as well as with the toothed wheel 38. On both sides of the toothed wheel 38 are formed two pin-shaped dead stops 80, 82. They are intended to co-operate with the pin 62 on the finger 60. The dead stops 80, 82 are such that in the respective final positions of the payout disc 20, the pin 62 approaches the dead stop 80 or 82, respectively. If for any reason the rotational direction reversal for the drive motor 42 does not function properly, the pin 62 engages with the respective stop 80 or 82, respectively. Through this, the finger 60 is deformed in the circumferential or rotational direction, respectively, until the pin hits one end of the slit 64. Thus, the rotation of the motor is resiliently intercepted, which prevents the same and the gearbox from damage when the control device does not work properly.

It must be underlined again that the described processes have been explained in the context of the accommodation 14 and the assigned parts and drives. It is to be understood that the same holds also for the accommodations 12 and 16, to which one pair of coin tubes is associated in the described manner also.

As can be recognised, the rotational angle of the payout discs 18 to 24 is only about 120° in the payout operation. In the payout and returning operation, a rotational angle of only 240° is therefore necessary altogether. This is in contrast to conventional payout apparatuses, in which an overall angle of rotation of 360° is required, namely plus and minus 180°. As a result, the payout operation is significantly faster with the described payout apparatus.

Figure 8:
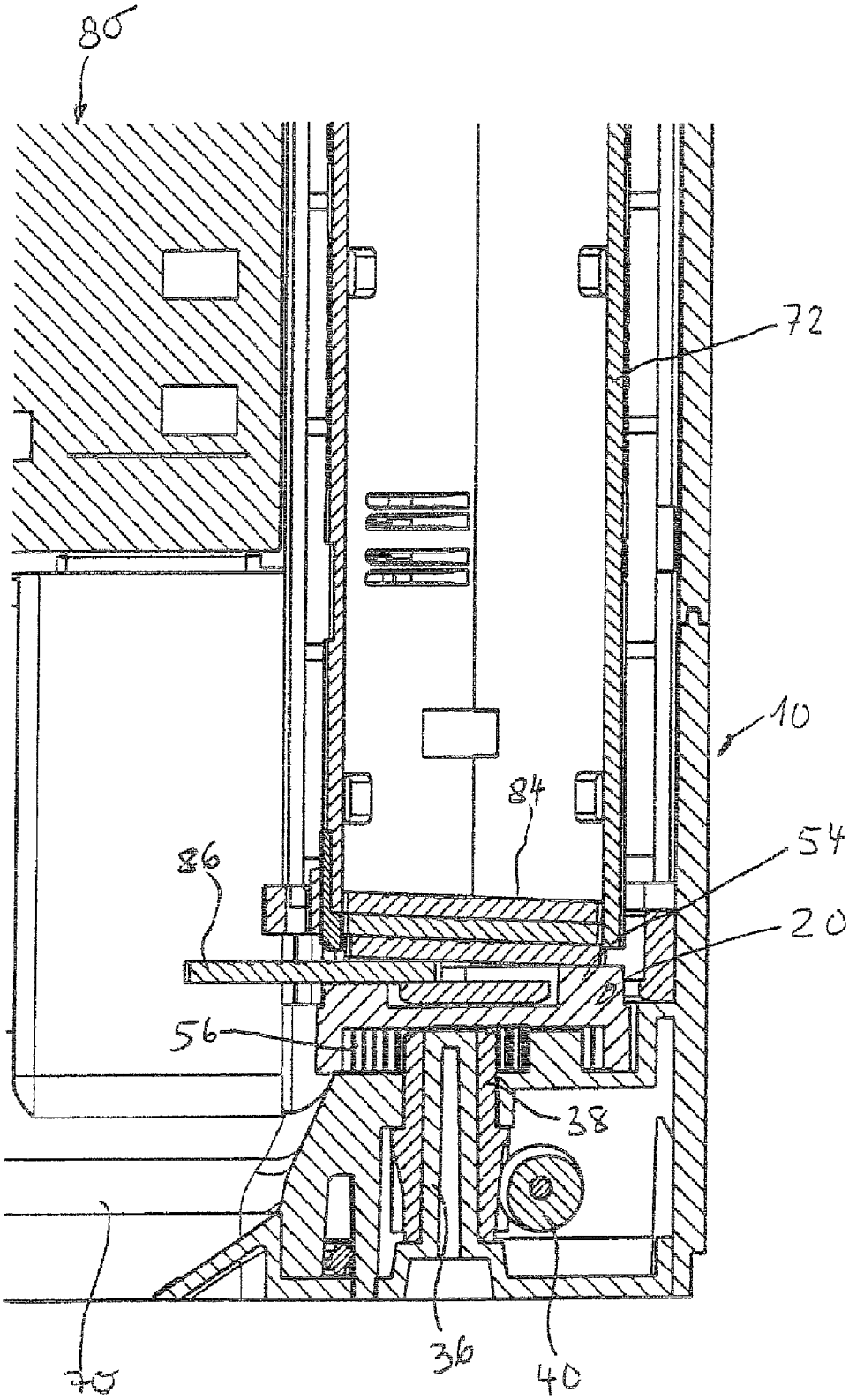
FIG. 8 shows a cross sectional depiction of a coin tube of a coin changing device, whose payout device is indicated in FIG. 1 and with which a payout disc according to the present invention is co-operating.

In FIG. 8, a casing 80 of a money changing apparatus is indicated, wherein the casing 70 can be set up on the casing 10, for instance according to FIG. 1. In the casing 80, a coin tube 72 is set in. In a money changing apparatus as described in the context of FIG. 1, six such coin tubes are used in total. One further recognises in FIG. 8 that a coin stack 84 of three coins is arranged in the coin tube 72. In addition, the payout disc 20 according to the above figures is indicated, with a lower hollow toothed wheel 56, into which the drive pinion 38 engages, which on its part is driven by the endless screw 40, which is for example driven by the motor 42 or the motor 44, respectively. In FIG. 8, the payout element 54 can be recognised also, which pushes out a coin 86, which was at the lowermost position of the stack 84, to the payout shaft 78.

The function of the payout disc 20 has already been explained by means of the above figures.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. An apparatus for the payout of coins from a pair of neighboring coin tubes, in which one stack of coins at a time is supported on a bottom of the coin tube, with a payout disc below the coin tubes, which is rotatably mounted around an axis parallel to the axis of the coin tubes and which has a payout element on the side facing the coin tubes, which is moved along a curved slit in the bottom of the respective coin tube in an angular rotation of the payout disc, in order to capture the respective lowermost coin and to push it out, with an electric drive motor for the payout disc and a control device, which triggers the drive motor such that departing from a rest position, the payout disc is rotated in an optional direction about a limited rotational angle up to a final position, and is consecutively turned back into the rest position, wherein the payout disc has an extension in the rotational direction by which the stack of coins rests on the payout element in the final position of the payout disc, comprising:

that on the lower side of the payout disc (20) a stopper element (62) is provided, which co-operates near the final positions with one dead stop (80, 82) at a time, the payout disc (20) has a first mark (66) on the side opposite to the stopper element (62) which is detectable by two sensors (S1, S2) arranged side by side, the payout disc (20) has further one second mark (68) at each of both sides of the stopper element (62) which is detectable by a sensor, wherein one of the second marks (68) are situated in the region of the sensor (S1, S2) when the payout disc is in one of the final positions, and the sensors (S1, S2) are connected to the control device and the control device reduces the speed of the drive motor (42) when one of the second marks (68) reaches the sensor (S1, S2) which is the first one in the rotational direction and reverses its rotational direction when it reaches the second sensor (S2, S1).

2. An apparatus according to claim 1, characterised in that the upper side of the payout element (54) has a fully planar surface area.

3. An apparatus according to claim 2, characterised in that the stopper element (62) is arranged to be resilient.

4. An apparatus according to claim 3, characterised in that the payout disc (20) is formed from plastic material and the stopper element (62) is formed on an elastically slewable finger (60).

5. An apparatus according to claim 1, characterised in that the payout disc (20) has a toothed ring (56) on its bottom side, which co-operates with a drive pinion (38) of the drive motor (42).

6. An apparatus according to claim 1, characterised in that the extension of the first mark (66) in the rotational direction of the payout disc (20) is somewhat greater than the distance of the sensors (S1, S2).

7. An apparatus according to claim 1, characterised in that the control device reverses the rotational direction of the drive motor (42) for position correction, when after reaching the rest position, the first mark (66) is moved out of the region of that sensor (S1, S2) which is the first one in the rotational direction.

8. An apparatus according to claim 1, characterised in that an optical or Hall Effect sensor is provided for the sensors (S1, S2).

9. An apparatus of the type having a payout of coins from a pair of neighboring coin tubes, in which one stack of coins at a time is supported on a bottom of the coin tube, with a payout disc below the coin tubes, which is rotatably mounted around an axis parallel to the axis of the coin tubes and which has a payout element on the side facing the coin tubes, which is moved along a curved slit in the bottom of the respective coin tube in an angular rotation of the payout disc, in order to capture the respective lowermost coin and to push it out, with an electric drive motor for the payout disc and a control device, which triggers the drive motor such that departing from a rest position, the payout disc is rotated in an optional direction about a limited rotational angle up to a final position, and is consecutively turned back into the rest position, wherein the payout disc has an extension in the rotational direction by which the stack of coins rests on the payout element in the final position of the payout disc, the improvement comprising:

that on the lower side of the payout disc (20) a stopper element (62) is provided, which co-operates near the final positions with one dead stop (80, 82) at a time;

the payout disc (20) has a first mark (66) on the side opposite to the stopper element (62) which is detectable by two sensors (S1, S2) arranged side by side;

the payout disc (20) has further one second mark (68) at each of both sides of the stopper element (62) which is detectable by a sensor, and wherein one of the second marks (68) are situated in the region of the sensor (S1, S2) when the payout disc is in one of the final positions, and the sensors (S1, S2) are connected to the control device and the control device reduces the speed of the drive motor (42) when one of the second marks (68) reaches the sensor (S1, S2) which is the first one in the rotational direction and reverses its rotational direction when it reaches the second sensor (S2, S1).

* * * * *